US005372232A

United States Patent [19]

Ahls et al.

[11] Patent Number: 5,372,232

[45] Date of Patent: Dec. 13, 1994

[54] HANDRAIL DRIVE PRESSURE CHAIN WITH SOFT ROLLERS

[75] Inventors: Hermann W. Ahls, Obernkirchen; Michael Kruse, Minden; Margarete Solbach, Helpsen, all of Germany

[73] Assignee: Otis Elevator Company, Farmington, Conn.

[21] Appl. No.: 216,985

[22] Filed: Mar. 23, 1994

[51] Int. Cl.[5] ..... B66B 23/04

[52] U.S. Cl. ..... 198/335

[58] Field of Search ..... 198/335, 336, 330, 331, 198/835

[56] References Cited

U.S. PATENT DOCUMENTS

| | | | |
|---|---|---|---|
| 3,490,191 | 1/1970 | Fukuyama et al. . | |
| 3,595,364 | 7/1971 | Schoneweiss . | |
| 3,651,919 | 3/1972 | Vollmer . | |
| 3,779,360 | 12/1973 | Taker et al. . | |
| 4,005,773 | 2/1977 | Bouilla . | |
| 4,134,883 | 1/1979 | Mendelsohn et al. . | |
| 4,200,177 | 4/1980 | Sato et al. | 198/335 |
| 4,875,568 | 10/1989 | Hermann et al. | 198/335 |
| 4,901,839 | 2/1990 | Johnson et al. | 198/335 |
| 4,998,613 | 3/1991 | Rivera et al. | 198/335 |
| 5,117,960 | 6/1992 | Ahls et al. . | |
| 5,125,494 | 6/1992 | Nurnberg et al. . | |

*Primary Examiner*—D. Glenn Dayoan

[57] ABSTRACT

An apparatus for driving a handrail of a passenger conveying device is provided, having a drive wheel and apparatus for pressuring the handrail against the drive wheel. The apparatus for pressuring includes a plurality of rollers, made of a polymeric material having a hardness range less than that of the handrail. Specifically, the polymeric material is made of a thermoplastic polyurethane elastomer having a Shore A hardness in a range equal to or greater than 62 and less than or equal to 68 Shore A.

14 Claims, 1 Drawing Sheet

HANDRAIL DRIVE PRESSURE CHAIN WITH SOFT ROLLERS

BACKGROUND OF THE INVENTION

1. Technical Field

This invention pertains to passenger conveying devices having handrails in general, and to handrail drives for passenger conveying devices in particular.

2. Background Art

Passenger conveying devices such as escalators and moving walkways are a well known means for conveying passengers from one point to another. Typically, passengers enter the device through a landing and step on to a moving step (or pallet, or belt, etc.). The moving step conveys the passenger(s) along at a relatively constant speed until he or she reaches the opposite landing. The passenger subsequently steps off the moving step and on to a stationary floorplate in the opposite landing, and is thereafter free to go as he or she pleases.

For safety reasons, it is well known in the art that a pair of handrails may be provided on both sides of the steps. The handrails facilitate the passengers ride, especially in the transition areas where the passenger is entering and exiting the device. The handrails typically travel a closed loop about a balustrade assembly, including a return trip within the base of the balustrade. The balustrade assemblies guide and support the handrail.

A handrail drive, enclosed within the passenger conveyor, drives the handrail about the guided path at approximately the same speed as the moving steps. A person of skill in the art will recognize that there are many handrail drive embodiments known. Most drives impart motion to the handrail by applying frictional force to the handrail, sometimes referred to as "pinching" the handrail within a nip point. U.S. Pat. No. 5,125,494 to Nurnberg et al. discloses that a handrail may be driven by pinching it between a belt and an idler pulley. U.S. Pat. No. 3,779,360 to Taher et al. discloses that a handrail may be driven by pinching it between a pressure roller and a traction roller.

A person of skill in the art will recognize that it is known to use polyurethane rollers in those embodiment using rollers. Polyurethane rollers provide several advantages including: the minimization of handrail discoloration, also known as "marking"; the minimization of scratching of the outer surface of the handrail; and the provision of a coefficient of friction sufficient to drive the handrail.

A person of skill in the art will recognize that indentations within the outer surface of the handrail often occur when a passenger conveying device is idled, for example, during weekends or non-peak hours. Indeed, many passenger conveying devices now may include controls which allow the device to be operated intermittently, thereby exacerbating the problem. The indentations occur because the handrail drive pinches a section of idled handrail for an extended period of time. It would be advantageous to minimize the magnitude of the indentations within the handrail and thereby decrease the amount of time it takes the elastic handrail to return to its normal profile.

SUMMARY OF THE INVENTION

It is, therefore, an object of the present invention to provide an apparatus for driving the handrail of a passenger conveying device that minimizes indentations in the handrail.

It is another object of the present invention to provide an apparatus for driving the handrail of a passenger conveying device that provides adequate traction to drive the handrail.

It is still another object of the present invention to provide an apparatus for driving the handrail of a passenger conveying device that minimizes discoloration of the handrail.

It is still another object of the present invention to provide an apparatus for driving the handrail of a passenger conveying device that minimizes scratching of the handrail.

According to the present invention, an apparatus for driving a handrail of a passenger conveying device is provided, comprising a drive wheel and means for pressuring the handrail against the drive wheel. The means for pressuring includes a plurality of rollers, comprising a polymeric material having a hardness range less than that of the handrail.

According to an aspect of the present invention, the polymeric material of the rollers has a Shore A hardness range defined as being equal to or greater than 62 and less than or equal to 68 Shore A hardness.

According to one embodiment of the present invention, the rollers comprise a polyurethane material.

According to another embodiment of the present invention, the rollers comprise a thermoplastic polyurethane elastomer.

An advantage of the present invention is that indentations created in the handrail after a period of inactivity, are minimized. A person of ordinary skill in the art will recognize that it is a considerable advantage to provide a handrail drive that provides adequate traction to drive the handrail while also minimizing the marking, scratching, and the creation of indentations in the handrail.

These and other objects, features and advantages of the present invention will become more apparent in light of the detailed description of the best mode embodiment thereof, as illustrated in the accompanying drawings.

BEST MODE FOR CARRYING OUT THE INVENTION

Figure 1:
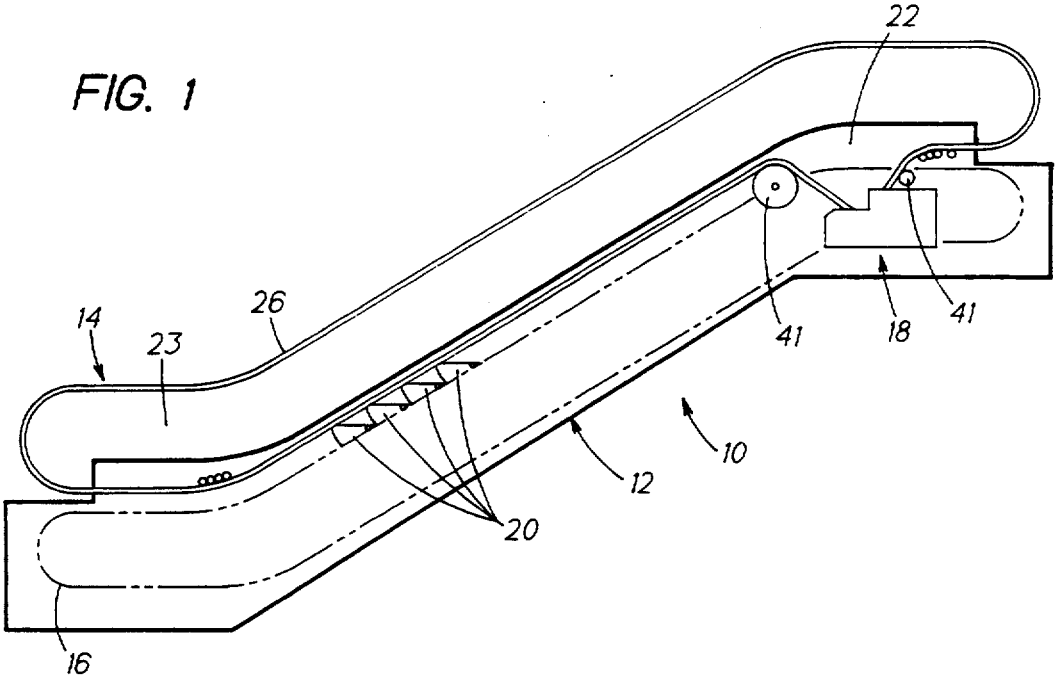
FIG. 1 is a diagrammatic view of an escalator, showing a handrail drive apparatus.

Referring to FIG. 1, an escalator 10 is shown diagrammatically having a truss frame 12, a balustrade 14, a step chain 16, and an apparatus 18 for driving a handrail 26. The step chain 16 travels a closed loop within the truss frame 12. Passengers (not shown) are conveyed from the entrance to the exit of the escalator 10 by a plurality of steps 20 attached to the step chain 16. The balustrade 14 includes a base 22, a plurality of balustrade panels 23, and an endless C-shaped handrail 26, as is known in the art. The handrail 26 travels a closed loop path around the periphery of the balustrade panels 23 and returns within the base 22 of the balustrade 14. During the portion of the handrail path within the balustrade base 22, the handrail 26 is diverted into the handrail drive apparatus 18.

Figure 2:
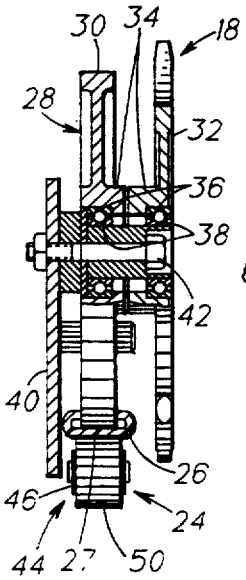
FIG. 2 is a enlarged front view of the handrail drive apparatus shown in FIG. 1.
Figure 3:
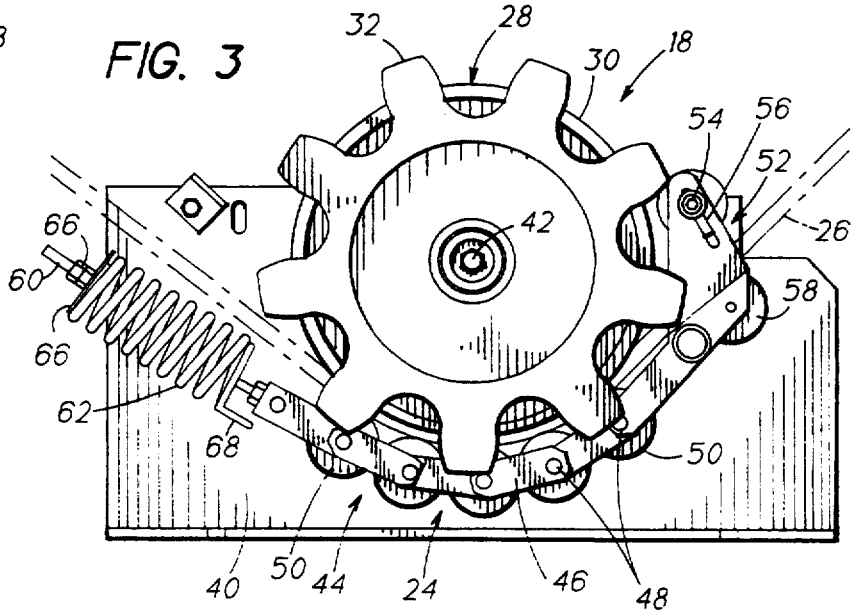
FIG. 3 is a cross-sectional view of the handrail drive apparatus shown in FIG. 2.

Referring to FIGS. 2 and 3, the handrail drive apparatus 18 comprises a drive wheel 28 having an outer radial surface 30, a step chain sprocket 32, and a roll chain 24 for pressuring the handrail 26 against the outer radial surface 30 of the drive wheel 28. The drive wheel 28 and step chain sprocket 32 are fixed and spaced apart from one another by their perspective hubs 34. The hubs 34 are mounted on bearings 36 which are in turn mounted on an inner bearing race 38. The inner bearing race 38 is attached to a mounting plate 40 by a bolt 42. The mounting plate 40 is attached to the truss frame 12 (see FIG. 1).

The roll chain 24 includes a plurality of links 44 each having a pair of sideplates 46. The links 44 are pivotly connected to each other by axles 48 that extend between the sideplates 46. A roller 50, having a diameter greater than the height of the sideplates 46 is pivotly mounted on each axle 48. In a first embodiment, the roller 50 comprises polyurethane. In a second embodiment, the roller 50 comprises a thermoplastic polyurethane elastomer. In both embodiments, the hardness of the roller 50 is less than that of the handrail 26, preferably having a Shore A hardness range of equal to or greater than 62, to equal to or less than 68 Shore A.

One end of the roll chain 24 is attached to an "L"-shaped bracket 52 mounted on the mounting plate 40. A bolt 54 extending through a slot 56 in the L-shaped bracket 52 provides both a pivot for the bracket 52 and a means for adjusting the position of the roll chain 24 relative to the drive wheel 28. Specifically, the bracket 52 and the roll chain 24 can be moved toward or away from the drive wheel 28 by changing the position of the bolt 54 within the slot 56. An idler roller 58 is attached to the bracket 52 to guide the handrail 26 into position between the rollers 50 and the drive wheel 28.

The other end of the roll chain 24 includes a threaded rod 60 pivotly attached to the end link of the roll chain 24, a coil spring 62, and a plate 64 attached to the rod 60 by a pair of nuts 66. The rod 60 passes through a bracket 68 attached to the mounting plate 40 and through the coil spring 62. The coil spring 62 acts against the bracket 68 on one side and against the plate 64 attached to rod on the other side.

Referring to FIGS. 1 and 3, a handrail drive 18 is installed on each side of the truss frame 12 to drive the handrail 26 on that particular side. The mounting plate 40 is attached to the truss frame 12 in a position that allows the step chain sprocket 32, and therefore the drive wheel 28, to be driven by the step chain 16 of the escalator 10. Depending upon the application, idler rollers 41 may be necessary to divert the handrail 26 toward the handrail drive 18.

Referring to FIGS. 1 and 2, after the handrail 26 has been installed along periphery of balustrade panels 23, within the base 22 of the balustrade 14, and around the drive wheel 28 of the handrail drive 18, the roll chain 24 is pivoted into position around the outside of the drive wheel 18. Gross positional adjustment of the roll chain 24 is accomplished by moving the L-shaped bracket 52 either toward or away from the drive wheel 28. When the bracket 52 is in the proper position, the position of the pivot bolt 54 within the slot 56 is fixed. Adjustment of the normal force exerted by the rollers 50 on the outer surface 27 of the handrail 26 is accomplished by compressing the coil spring 62. A person of skill in the art will recognize that the normal force, and therefore the frictional force on the handrail 26, may be adjusted to predetermined magnitudes based on the amount of spring compression.

The present invention provides a proven apparatus for minimizing an undesirable condition in handrails 26. A person of skill in the art will recognize that the "feel" and "look" of a handrail are perceived as important indicia of the quality of a passenger conveying device. Improvements in either are, therefore, desirable and provide a competitive advantage.

Although this invention has been shown and described with respect to the detailed embodiments thereof, it will be understood by those skilled in the art that various changes in form and detail thereof may be made without departing from the spirit and scope of the claimed invention. Specifically, rollers having a hardness range less than that of the handrail may be used in a variety of different handrail drives.

We claim:

1. An apparatus for driving a handrail of a passenger conveying device, comprising:

a drive wheel, having an outer radial surface in contact with said handrail, for imparting motion to said handrail;

means for pressuring said handrail against said outer radial surface of said drive wheel, wherein said means for pressuring includes:

a plurality of rollers, comprising a polyurethane material having a Shore A hardness in a range equal to or greater than 62 and less than or equal to 68 Shore A;

wherein said hardness range of said rollers is less than that of said handrail, said means for pressuring thereby minimizing disfiguration of said handrail that occurs when said handrail is not in motion.

2. An apparatus for driving a handrail of a passenger conveying device according to claim 1, wherein said means for pressuring said handrail further comprises:

a chain, having a plurality of links, each link having a pair of sideplates, said sideplates connected by a plurality of axles extending therebetween, said rollers rotatably mounted between said sideplates;

a first bracket, for attaching an end of said chain to said passenger conveying device; and means for adjustably tensioning said rollers against said handrail, thereby adjusting said pressure against said handrail.

3. An apparatus for driving a handrail of a passenger conveying device according to claim 2, wherein said means for adjustably tensioning said rollers against said handrail comprises:

a biasing means, having an adjustable magnitude;

a second bracket, pivotly attached to said chain, for cooperating with said biasing means;

wherein said magnitude of said biasing means may be altered by adjusting said second bracket.

4. An apparatus for driving a handrail of a passenger conveying device according to claim 3, wherein said first bracket further comprises:

an idler roller, for guiding said handrail between said drive wheel and said rollers; and a slot, for adjusting the position of said bracket relative to said drive wheel.

5. An apparatus for driving a handrail of a passenger conveying device, comprising:

a drive wheel, having an outer radial surface in contact with said handrail, for imparting motion to said handrail;

means for pressuring said handrail against said outer radial surface of said drive wheel, wherein said means for pressuring includes:

a plurality of rollers, comprising a thermoplastic polyurethane elastomer material having a Shore A hardness in a range equal to or greater than 62 and less than or equal to 68 Shore A;

wherein said hardness range of said rollers is less than that of said handrail, said means for pressuring thereby minimizing disfiguration of said handrail that occurs when said handrail is not in motion.

6. An apparatus for driving a handrail of a passenger conveying device according to claim 5, wherein said means for pressuring said handrail further comprises:

a chain, having a plurality of links, each link having a pair of sideplates, said sideplates connected by a plurality of axles extending therebetween, said rollers rotatably mounted between said sideplates;

a bracket, for attaching an end of said chain to said passenger conveying device; and means for adjustably tensioning said rollers against said handrail, thereby adjusting said pressure against said handrail.

7. An apparatus for driving a handrail of a passenger conveying device according to claim 6, wherein said means for adjustably tensioning said rollers against said handrail comprises:

a biasing means, having an adjustable magnitude;

a bracket, pivotly attached to said chain, for cooperating with said biasing means;

wherein said magnitude of said biasing means may be altered by adjusting said bracket.

8. An apparatus for driving a handrail of a passenger conveying device according to claim 7, wherein said first bracket further comprises:

an idler roller, for guiding said handrail between said drive wheel and said rollers; and a slot, for adjusting the position of said bracket relative to said drive wheel.

9. A passenger conveying device, comprising:

an endless handrail, having a inner and an outer major surface;

a balustrade, for guiding said handrail in a closed loop; and means for driving said handrail in said closed loop including:

a drive wheel, having an outer radial surface in contact with said inner major surface of said handrail;

means for pressuring said handrail against said outer radial surface of said drive wheel, wherein said means for pressuring includes:

a plurality of rollers, comprising a thermoplastic polyurethane elastomer material having a Shore A hardness in a range equal to or greater than 62 and less than or equal to 68 Shore A;

wherein said hardness range of said rollers is less than that of said handrail, said means for pressuring thereby minimizing disfiguration of said handrail that occurs when said handrail is not in motion.

10. A passenger conveying device according to claim 9, wherein said means for pressuring said handrail further comprises:

a chain, having a plurality of links, each link having a pair of sideplates, said sideplates connected by a plurality of axles extending therebetween, said rollers rotatably mounted between said sideplates;

a bracket, for pivotly attaching an end of said chain to said passenger conveying device; and means for adjustably tensioning said rollers against said handrail, thereby adjusting said pressure against said handrail.

11. A passenger conveying device according to claim 10, wherein said means for adjustably tensioning said rollers against said handrail comprises:

a biasing means, having an adjustable magnitude;

a bracket, pivotly attached to said chain, for cooperating with said biasing means;

wherein said magnitude of said biasing means may be altered by adjusting said bracket.

12. A passenger conveying device, comprising:

an endless handrail, having a inner and an outer major surface;

a balustrade, for guiding said handrail in a closed loop; and means for driving said handrail in said closed loop including:

a drive wheel, having an outer radial surface in contact with said inner major surface of said handrail;

means for pressuring said handrail against said outer radial surface of said drive wheel, wherein said means for pressuring includes:

a plurality of rollers, comprising a polyurethane material having a Shore A hardness in a range equal to or greater than 62 and less than or equal to 68 Shore A;

wherein said hardness range of said rollers is less than that of said handrail, said means for pressuring thereby minimizing disfiguration of said handrail that occurs when said handrail is not in motion.

13. A passenger conveying device according to claim 12, wherein said means for pressuring said handrail further comprises:

a chain, having a plurality of links, each link having a pair of sideplates, said sideplates connected by a plurality of axles extending therebetween, said rollers rotatably mounted between said sideplates;

a bracket, for pivotly attaching an end of said chain to said passenger conveying device; and means for adjustably tensioning said rollers against said handrail, thereby adjusting said pressure against said handrail.

14. A passenger conveying device according to claim 13, wherein said means for adjustably tensioning said rollers against said handrail comprises:

a biasing means, having an adjustable magnitude;

a bracket, pivotly attached to said chain, for cooperating with said biasing means;

wherein said magnitude of said biasing means may be altered by adjusting said bracket.

* * * * *